US010679492B2

(12) United States Patent
DiPoala et al.

(10) Patent No.: US 10,679,492 B2
(45) Date of Patent: Jun. 9, 2020

(54) MOTION SENSOR WITH ANTIMASK PROTECTION

(71) Applicant: Robert Bosch GmbH, Stuttgart (DE)

(72) Inventors: William DiPoala, Fairport, NY (US); Lev Altman, Fairport, NY (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/325,364

(22) PCT Filed: Aug. 15, 2017

(86) PCT No.: PCT/EP2017/070686
§ 371 (c)(1),
(2) Date: Feb. 13, 2019

(87) PCT Pub. No.: WO2018/033545
PCT Pub. Date: Feb. 22, 2018

(65) Prior Publication Data

US 2019/0206235 A1 Jul. 4, 2019

Related U.S. Application Data

(60) Provisional application No. 62/376,783, filed on Aug. 18, 2016.

(51) Int. Cl.
*G08B 29/00* (2006.01)
*G08B 29/04* (2006.01)
(Continued)

(52) U.S. Cl.
CPC ..... *G08B 29/046* (2013.01); *G08B 13/22* (2013.01); *G08B 13/2491* (2013.01)

(58) Field of Classification Search
None
See application file for complete search history.

(56) References Cited

U.S. PATENT DOCUMENTS 5,499,016 A 3/1996 Pantus
6,262,661 B1 7/2001 Mahler et al.
(Continued)

FOREIGN PATENT DOCUMENTS

CN 101608951 A 12/2009
CN 202093634 U 12/2011

OTHER PUBLICATIONS

First Office Action from the National Intellectual Property Administration, P.R. China for Application No. 201780050448.6 dated Mar. 23, 2020 (11 pages).

*Primary Examiner* — Adolf Dsouza
(74) *Attorney, Agent, or Firm* — Michael Best & Friedrich LLP

(57) ABSTRACT

A device and method for detecting motion with antimasking capability. In one example, the device includes an antenna, a dual-channel reception circuit, and an electronic processor. The dual-channel reception circuit includes a first channel and a second channel. The electronic processor is electrically connected to the dual-channel reception circuit and is configured to receive a first signal from the first channel indicative of motion at a first range, and receive a second signal from the second channel indicative of motion at a second range. At least a portion of the second range is shorter than the first range. Based on the first signal and the second signal, the electronic processor is configured to generate a notification.

20 Claims, 4 Drawing Sheets

(51) Int. Cl.
*G08B 13/24* (2006.01)
*G08B 13/22* (2006.01)

(56) References Cited

U.S. PATENT DOCUMENTS

| | | | | |
|---|---|---|---|---|
| 2008/0218341 | A1* | 9/2008 | Royer | G01S 13/56 340/567 |
| 2009/0079564 | A1 | 3/2009 | Wu et al. | |
| 2009/0303069 | A1 | 12/2009 | Carl, Jr. | |
| 2010/0013636 | A1 | 1/2010 | Wu | |

* cited by examiner

MOTION SENSOR WITH ANTIMASK PROTECTION

FIELD

Embodiments relate to motion detection alarm systems.

BACKGROUND

Some motion detectors used in modern security systems may be defeated by placing a masking material on the face the detector. Due to this, some motion detectors incorporate an antimasking system to detect such events. Motion detectors with antimasking capabilities may be used in high-security alarm systems. Motion detectors with antimasking capabilities typically incorporate an active infrared detection system to detect masking attempts. Infrared detection, however, has its own drawbacks and may be defeated by someone knowledgeable about the device.

In addition, false alarms may be generated by motion detectors. The false alarms may be generated based on detection of domestic pets, insects, birds, and others in close proximity to the motion sensor. False alarms may also be generated by the antimasking detection. For example, antimasking devices using infrared sensors may be triggered based on detection of light sources and light-reflective objects within a detection area such as sunlight reflections, bugs on the face of the detector, and others. As a consequence, motion detectors that include infrared antimasking capability may be prone to generating false alarms.

SUMMARY

Embodiments provide, among other things, a system and a method of motion detection that address the above-listed problems. Embodiments provide a dual-channel reception circuit that uses Doppler technology to detect motion. The dual-channel reception circuit processes radio frequency (RF) reflections from objects using two independent receiver channels. A first channel provides motion detection within a first range. The second channel provides motion detection within a second range that is generally closer to the motion detector than the first range. The first channel provides detection of intruders while the second channel provides antimask protection for the motion detector.

One embodiment provides a motion detector with antimasking capability including an antenna and a dual-channel reception circuit. The dual-channel reception circuit is configured to receive a reflected radio frequency (RF) signal. The motion detector also includes an electronic processor electrically connected to the dual-channel reception circuit. The electronic processor is configured to receive a first signal from a first channel of the dual-channel reception circuit indicative of motion at a first range, and receive a second signal from a second channel of the dual-channel reception circuit indicative of motion at a second range. At least a portion of the second range is shorter than the first range. The electronic processor is further configured to generate a notification based on the first signal and the second signal.

Another embodiment provides a method of detecting motion using a motion detector with antimasking capability. The method includes receiving a first signal from a first channel of a dual-channel reception circuit indicative of motion at a first range, and receiving a second signal from a second channel of the dual-channel reception circuit indicative of motion at a second range. At least a portion of the second range is shorter than the first range. The method further includes generating, by an electronic processor, a notification based on the first signal and the second signal.

Yet another embodiment provides a motion detector with antimasking capability. The motion detector includes a radio frequency (RF) transmission circuit, a first RF reception circuit including a first amplifier electrically connected to a first mixer, and a second RF reception circuit including a second amplifier electrically connected to a second mixer. The second RF reception circuit is electrically connected in parallel with the first RF transmission circuit. The motion detector includes an electronic processor that is electrically connected to the RF transmission circuit, the first RF reception circuit, and the second RF reception circuit. The electronic processor is configured to generate an RF signal via the RF transmission circuit, send a first control signal to the first RF reception circuit to generate a first Doppler signal indicative of motion at a first distance, and send a second control signal to the second RF reception circuit to generate a second Doppler signal indicative of motion at a second distance. The second distance is shorter than the first distance. The electronic processor is further configured to generate a notification based, at least in part, on the first Doppler signal and the second Doppler signal.

DETAILED DESCRIPTION

Before any embodiments are explained in detail, it is to be understood that this disclosure is not intended to be limited in its application to the details of construction and the arrangement of components set forth in the following description or illustrated in the following drawings. Embodiments are capable of other configurations and of being practiced or of being carried out in various ways.

Figure 1:
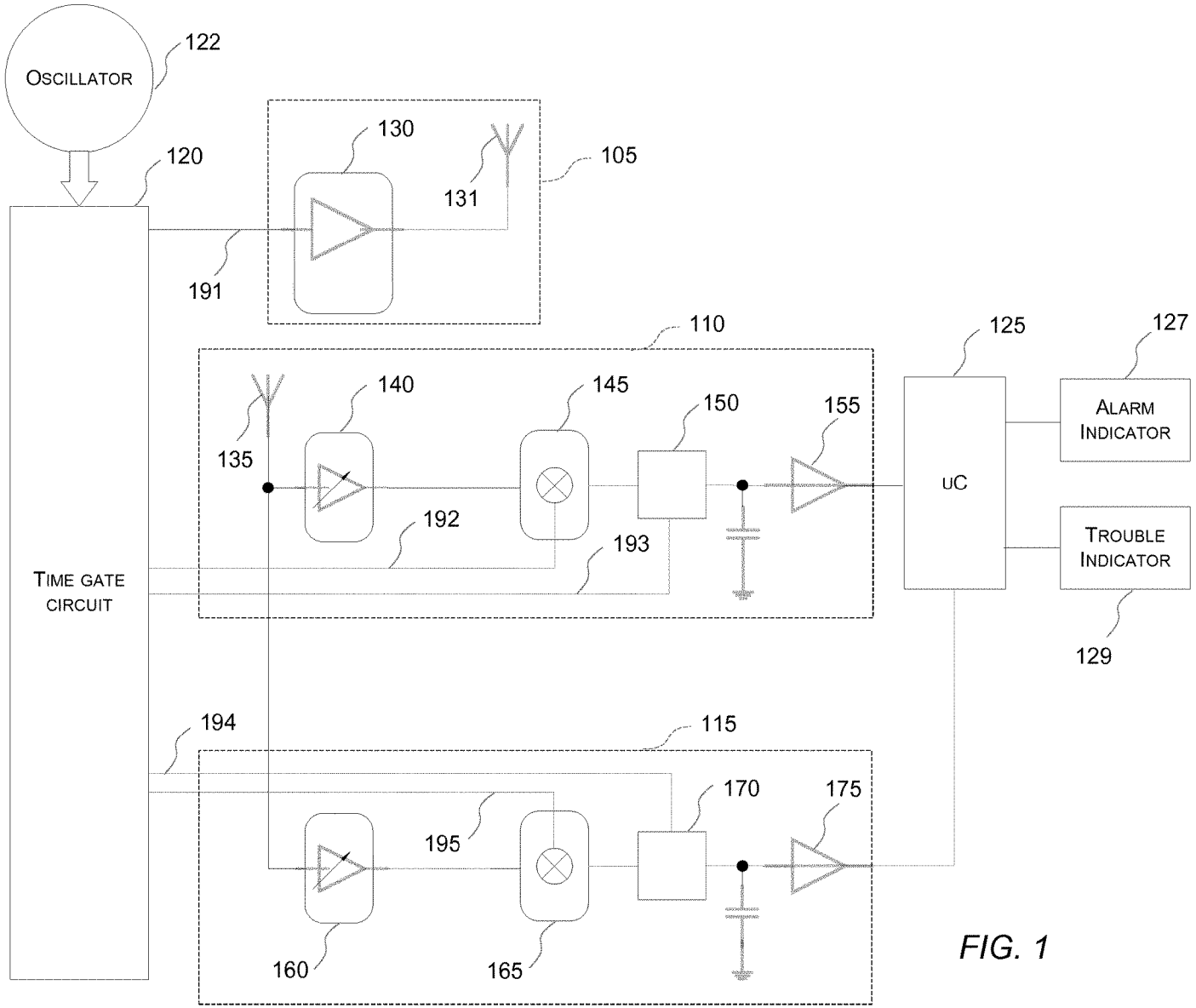
FIG. 1 is a block diagram of motion detector with dual-channel reception and antimasking according to one embodiment.

FIG. 1 illustrates an example of a motion detector 100 with antimask protection. In the example illustrated, the motion detector 100 includes a radio frequency (RF) transmission circuit 105, a first reception circuit 110 (i.e., a first channel), and a second reception circuit 115 (i.e., a second channel). A time gate circuit 120 is electrically connected to the RF transmission circuit 105, the first reception circuit 110, and the second reception circuit 115. The time gate circuit 120 is also electrically connected to an oscillator 122. The time gate circuit 120 includes discrete hardware such as capacitors and resistors to set control timing and synchronicity of transmission and reception of radio frequency (RF) signals. The time gate circuit 120 is configured to send control signals to the RF transmission circuit 105, the first reception circuit 110, and the second reception circuit 115 based on the frequency of the oscillator 122.

The motion detector 100 also includes a microcontroller 125, an alarm indicator 127, and a trouble indicator 129. The microcontroller 125 is configured to receive a first signal from the first reception circuit 110 and a second signal from the second reception circuit 115. Based on the first signal and the second signal, the microcontroller 125 is configured to generate one or more notifications to send to the alarm indicator 127, the trouble indicator 129, or both.

In some embodiments, the alarm indicator 127 and the trouble indicator 129 are incorporated within the motion detector 100. For example, the motion detector 100 may include a visual indicator (for example, a light, a display, etc.), an audial indicator (a beep, siren, tone, etc.), or both positioned at the motion detector 100. In other embodiments, the alarm indicator 127 and the trouble indicator 129 are located at a location external to the motion detector 100. For example, the motion detector 100 may include one or more digital outputs that are communicatively connected to the alarm indicator 127 and the trouble indicator 129. In this instance, the motion detector 100 may communicate with the alarm indicator 127 and the trouble indicator 129 via a wired or wireless connection. In some embodiments, the alarm indicator 127 and the trouble indicator 129 are incorporated into a central computer system such as a security alarm system or building control system.

The RF transmission circuit 105 includes an RF shape generator 130 (for example, a circuit that provides a shaped RF burst), and a transmission antenna 131. The time gate circuit 120, the shape generator 130, and the transmission antenna 131 operate in conjunction to generate and transmit RF pulses (for example, microwave pulses) designed to reflect from objects within an area under surveillance. In some embodiments, the RF shape generator 130 generates RF bursts in the microwave spectrum including, for example, an RF burst centered at 7.5 GHz. Timing of the transmission of the RF burst is controlled by the time gate circuit 120. In one embodiment, the RF burst is transmitted repeatedly and periodically at 1 microsecond intervals. In one example, when the RF burst is centered at 7.5 GHz, the RF burst occurs within a short timespan (for example, 2 ns). The RF burst is generated within ECCDec0604 requirements for wireless transmission. Additionally, the RF burst is shaped to be in compliance with RF spectral density requirements regulated by the Federal Communications Commission (FCC) or the European Commission.

The first reception circuit 110 and the second reception circuit 115 receive RF reflections that occur do to the RF bursts via a reception antenna 135. The RF reflections are reflected from objects within the area under surveillance. In some embodiments, the first reception circuit 110 processes received RF reflections in parallel and with the second reception circuit 115. The first reception circuit 110 includes a first amplifier 140 (for example, a low-noise amplifier or a gain control amplifier), a first mixer 145, a first sample-and-hold circuit 150, and a first operational amplifier (op-amp) 155. The above-listed components are electrically connected in series in the order listed from the reception antenna 135 to the first operational amplifier 155. The first mixer 145 and the first sample-and-hold circuit 150 are electrically connected to the time gate circuit 120 and, during operation, receive control signals from the time gate circuit 120.

The second reception circuit 115 includes a second amplifier 160 (for example, a low-noise amplifier or a gain control amplifier), a second mixer 165, a second sample-and-hold circuit 170, and a second operational amplifier (op-amp) 175. The above-listed components are electrically connected in series in the order listed from the reception antenna 135 to the second operational amplifier 175. The second mixer 165 and the second sample-and-hold circuit 170 are electrically connected to the time gate circuit 120 and, during operation, receive control signals from the time gate circuit 120. Although the first reception circuit 110 and the second reception circuit 115 may be active simultaneously, the control timing, as set by the time gate circuit 120, is different for the first reception circuit 110 and the second reception circuit 115. In some embodiments, the second reception circuit 115 receives the reflected RF signal from the reception antenna 135 and process the reflected RF signal simultaneously with the first reception circuit 110. The second reception circuit also may receive control signals from the time gate circuit simultaneously as the first reception circuit 115.

Figure 2:
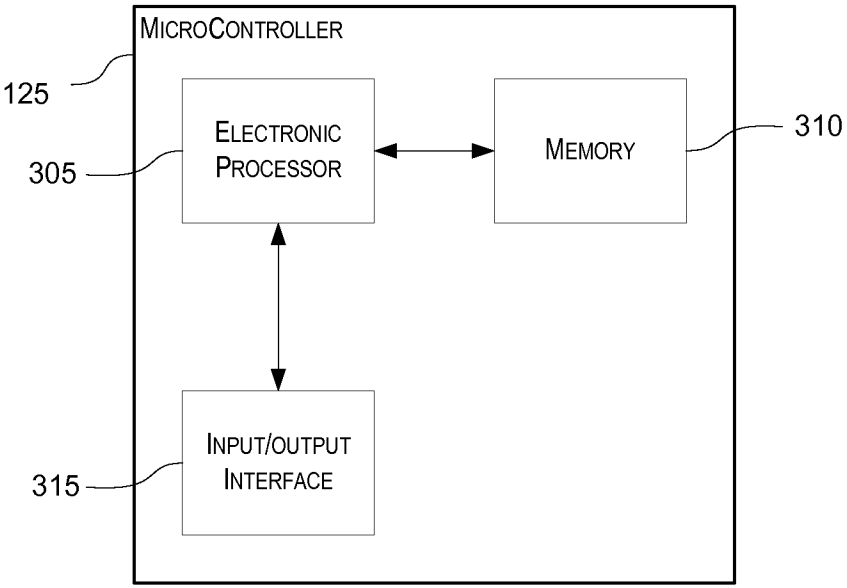
FIG. 2 is a block diagram of a controller for the motion detector of FIG. 1 according to one embodiment.

FIG. 2 is a block diagram of the microcontroller 125 of the motion detector 100 according to one embodiment. The microcontroller 125 includes a plurality of electrical and electronic components that provide power, operational control, and protection to the components and modules within the microcontroller 125. The microcontroller 125 includes, among other things, an electronic processor 205 (such as a programmable electronic microprocessor, microcontroller, or similar device), a memory 210 (for example, non-transitory, machine readable memory), and an input/output interface 215. In some embodiments, the microcontroller 125 includes additional, fewer, or different components.

The microcontroller 125 may be implemented in multiple electronic processors, application specific integrated circuits (ASICs), and other hardware configurations. The microcontroller 125 is configured to receive inputs from each of the first reception circuit 110 and the second reception circuit 115 and process each of these inputs independently. For example, the electronic processor 205 is configured to retrieve from memory 210 and execute, among other things, instructions related to retrieving a first signal from the first reception circuit 110 and a second signal from the second reception circuit 115, comparing the first signal to a first threshold, comparing the second signal to a second threshold, and activing the alarm indicator 127 and the trouble indicator 129 based on the thresholds. These functions are discussed in more detail below.

During operation of the motion detector 100, the first mixer 145 and the second mixer 165 each generate difference signals based on the RF reflections. The difference signals are indicative of motion occurring within the area under surveillance. A first difference signal is generated by the first mixer 145 that is indicative of motion occurring within a first range. Similarly, a second difference signal is generated by the second mixer 165 that is indicative of motion occurring within a second range. The first and second ranges are dependent on the control signals generated by the time gate circuit 120. Thus, when timing of the time gate circuit 120 is configured, the first and second ranges may be set to desired values.

In one embodiment, the first difference signal is indicative of motion occurring between approximately 3 feet and 50 feet from the motion detector 100. As a consequence, the first difference signal is indicative of motion occurring due to a person moving through (for example, an intruder) the surveillance area. In one embodiment, the second difference signal is indicative of motion occurring between approximately 1 foot and 3 feet from the motion detector 100. In this way, the second difference signal is indicative of motion occurring due to a person attempting to bypass or otherwise tamper with the motion detector 100.

The first sample-and-hold circuit 150 and the second sample-and-hold circuit 170 generate continuous-wave, Doppler signals based on the first difference signal and the second difference signal, respectively. In some embodiments, the Doppler signals are low frequency signals (for example, 0.1 to 100 Hz signals) that are amplified by the first operational amplifier 155 and the second operational amplifier 175, respectively. These Doppler signals result in a first signal output from the first reception circuit 110 indicative of motion occurring within the first range and a second signal output from the second reception circuit 115 indicative of motion occurring within the second range. The first and second signals are then input to the microcontroller 125. The first and second signals may each use dedicated inputs on the microcontroller 125.

Figure 3:
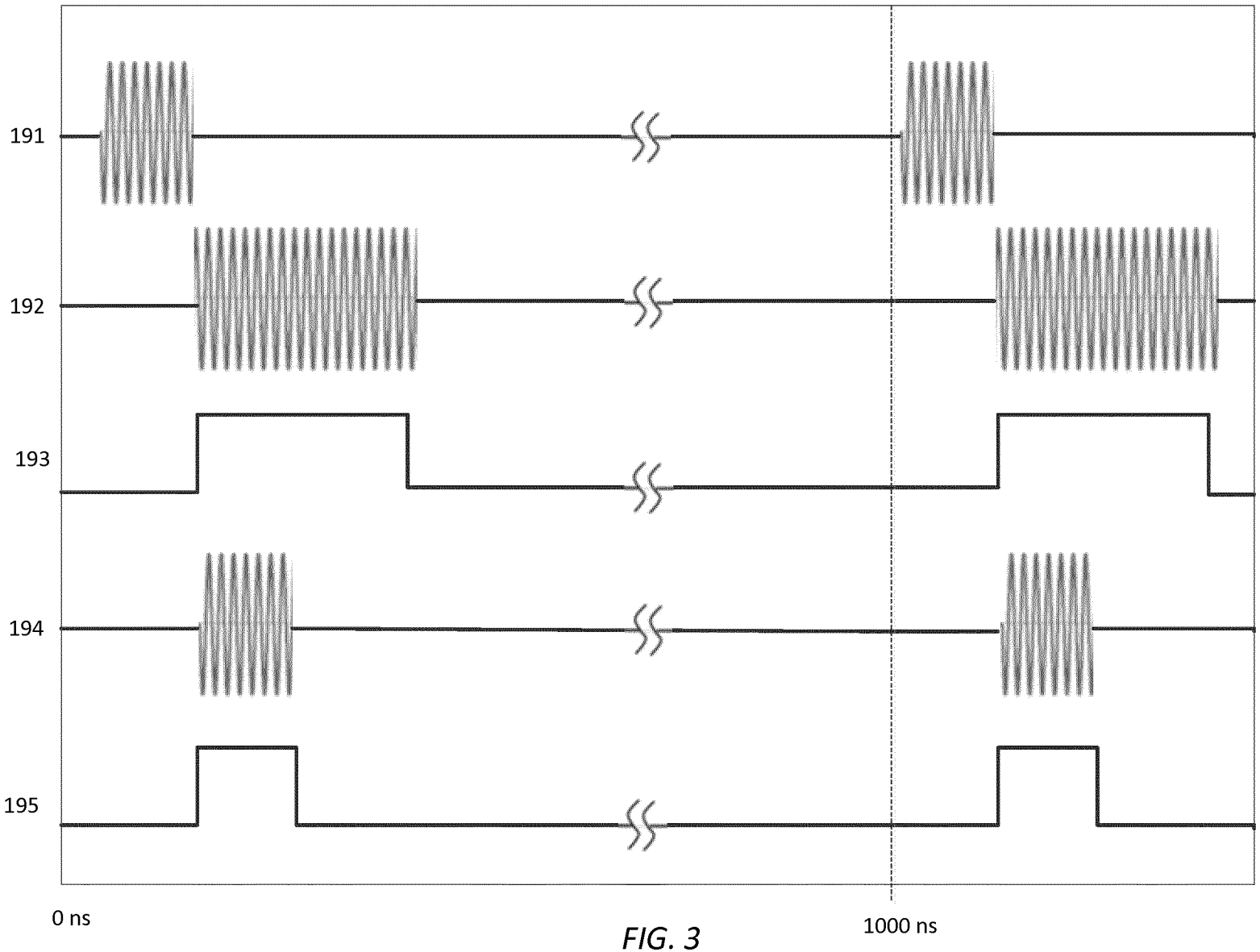
FIG. 3 is a timing diagram for controlling operation of the motion detector of FIG. 1 according to one embodiment.

FIG. 3 illustrates one example of control signals for the transmission circuit 105, the first reception circuit 110, and the second reception circuit 115. The time gate circuit 120 is configured to generate multiple control signals including the transmission control signal 191 to control the shape generator 130, the first mixer control signal 192 to control the first mixer 145, the first sample-and-hold control signal 193 to control the first sample-and-hold circuit 150, the second mixer control signal 194 to control the second mixer 165, and the second sample-and-hold control signal 195 to control the second sample-and-hold circuit 170.

In the example illustrated, the first mixer control signal 192 and the second mixer control signal 194 become active (for example, are modulated) after the transmission control signal 191 becomes inactive. In effect, the first reception circuit 110 and the second reception circuit 115 become operative once the RF burst transmission is completed. This prevents saturation of the first reception circuit 110 and the second reception circuit 115 with feedback from the RF burst. This also delays detection of motion of objects that are extremely close to the motion detector 100. In one example, motion from objects within 1 foot from the motion detector 100 will be ignored. These objects are ones that may cause false alarms such as spiders or insects crawling on or near to the motion detector 100.

In the example of FIG. 3, the motion detector 100 is set to a detection range of 50 feet. The RF burst travels approximately 1 ft/ns. Since the RF burst travels roundtrip to a target and back to the motion detector 100, it takes approximately 2 ns per foot of detection range. In this example, the first mixer control signal 192 activates the first mixer 145 for 100 ns. This limits the maximum detection range of the first channel to 50 feet. RF reflections received after 100 ns do not pass through the first mixer 145 due to the lack of the first mixer control signal 192 after 100 ns.

The second reception circuit 115 is configured for a shorter detection range to provide masking detection for the motion detector 100. In the example of FIG. 3, the second mixer control signal 194 is activated for 10 ns to limit detection to a range of 5 feet. In this way, any motion that occurs within the range set by the second mixer control signal 194 is likely to be indicative of masking attempts to the motion detector 100. The second mixer control signal 194 may be delayed by a small time interval (for example, 2 ns) to prevent detection of motion of spiders and insects as described above.

Figure 4:
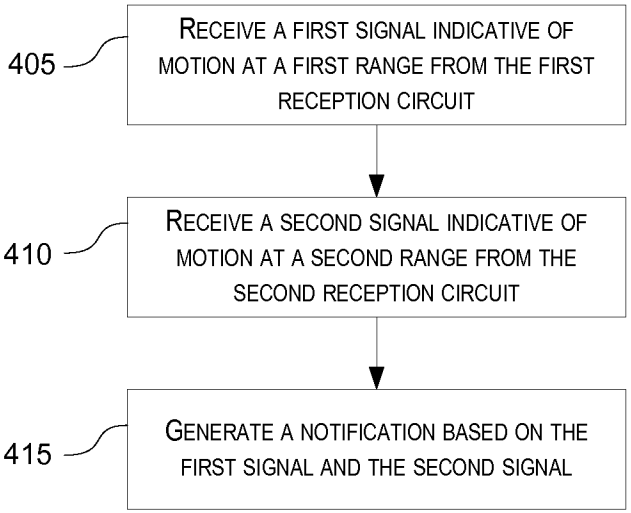
FIG. 4 is a flowchart of a method of operating the motion detector of FIG. 1 according to one embodiment.

FIG. 4 illustrates a method of operating the motion detector 100 according to one embodiment. In the method illustrated, a first signal indicative of motion at a first range is received at the microcontroller 125 from the first reception circuit 110 (block 405). The first signal is generated based on the received, RF reflections and the first mixer control signal 192. The first signal is dependent on the amount of motion of an object located within the first range. As a consequence, the microcontroller 125 may determine whether a moving object is present within the first range and may determine an amount of movement of the object based on the first signal.

The microcontroller 125 also receives a second signal indicative of motion at a second range from the second reception circuit 115 (block 410). The second signal is generated based on the received, RF reflections and the second mixer control signal 194. The second signal is dependent on the amount of motion of an object located within the second range. As a consequence, the microcontroller 125 may determine whether a moving object is present within the second range and may determine an amount of movement of the object based on the second signal.

The microcontroller 125 generates a notification based on the first signal and the second signal (block 415). In some embodiments, the microcontroller 125 includes multiple thresholds for triggering notifications. For example, the microcontroller 125 may generate an alarm notification for the alarm indicator 127 when the first signal received from the first reception circuit 110 has a magnitude above an alarm threshold. Similarly, the microcontroller 125 generates a trouble notification for the trouble indicator 129 when the second signal received from the second reception circuit 115 has a magnitude above a trouble threshold.

In one embodiment, the microcontroller 125 activates the alarm indicator 127 anytime the first signal has a magnitude above the alarm threshold regardless of the behavior of the second signal. Similarly, in one embodiment, the microcontroller 125 activates the trouble indicator 129 anytime the second signal has a magnitude above the trouble threshold. However, in other embodiments, the microcontroller 125 activates the trouble indicator 129 only when the first signal has a magnitude above the alarm threshold and when the second signal has a magnitude above the trouble threshold.

In some embodiments, the alarm threshold and the trouble threshold are adjustable by programming the microcontroller 125. For example, the alarm threshold and the trouble threshold may be adjusted to change the sensitivity of the motion detector 100. In this way, the motion detector 100 may react differently (i.e., have different sensitivities) to motion indicative of an intruder and motion indicative of a masking attempt.

In some embodiments, the alarm threshold and the trouble threshold may be adjusted automatically by the microcontroller 125. For example, the trouble threshold may be reduced to a lesser value (and thus, a higher sensitivity) when the microcontroller 125 receives a first signal with a magnitude above the alarm threshold. Thus, when the motion detector 100 detects an intruder, the sensitivity to masking attempts may be increased. In some embodiments, the trouble threshold is reduced in proportion to increases in magnitude of the first signal. As a consequence, trouble indications occur more frequently when small amounts of motion are detected by the first reception circuit 110, even when these small amounts are not sufficient to trigger the alarm notification.

Thus, embodiments of the invention provide, among other things, a motion detector for using a dual-channel reception circuit with antimasking protection.

It should be noted that this disclosure includes references to "one embodiment," "an embodiment," and "some embodiments," which do not necessarily refer to the same embodiment. Particular features, structures, or characteristics may be combined in any suitable manner consistent with this disclosure.

"Configured To." Various units, circuits, or other components may be described or claimed as "configured to"

perform a task or tasks. In such contexts, "configured to" is used to connote structure by indicating that the units/circuits/components include structure (e.g., circuitry) that performs those task or tasks during operation. As such, the unit/circuit/component can be said to be configured to perform the task even when the specified unit/circuit/component is not currently operational (e.g., is not on). The units/circuits/components used with the "configured to" language include hardware—for example, circuits, memory storing program instructions executable to implement the operation, etc. Reciting that a unit/circuit/component is "configured to" perform one or more tasks is expressly intended not to invoke 35 U.S.C. § 112(f), for that unit/circuit/component. Additionally, "configured to" can include generic structure (e.g., generic circuitry) that is manipulated by software and/or firmware (e.g., an FPGA or a general-purpose processor executing software) to operate in manner that is capable of performing the task(s) at issue. "Configure to" may also include adapting a manufacturing process (e.g., a semiconductor fabrication facility) to fabricate devices (e.g., integrated circuits) that are adapted to implement or perform one or more tasks.

"First," "Second," etc. As used herein, these terms are used as labels for nouns that they precede, and do not imply any type of ordering (e.g., spatial, temporal, logical, etc.). For example, a buffer circuit may be described herein as performing write operations for "first" and "second" values. The terms "first" and "second" do not necessarily imply that the first value must be written before the second value.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While in this case, B is a factor that affects the determination of A, such a phrase does not foreclose the determination of A from also being based on C. In other instances, A may be determined based solely on B.

What is claimed is:

1. A motion detector with antimasking capability, the motion detector comprising:

an antenna;

a dual-channel reception circuit, the dual-channel reception circuit configured to receive a reflected radio frequency (RF) signal; and an electronic processor electrically connected to the dual-channel reception circuit and configured to receive a first signal from a first channel of the dual-channel reception circuit indicative of motion at a first range, receive a second signal from a second channel of the dual-channel reception circuit indicative of motion at a second range, at least a portion of the second range being shorter than the first range, generate an alarm notification indicative of an alarm condition when the first signal is indicative of motion at the first range, and generate a trouble notification indicative of a masking attempt when the second signal indicates motion at the second range, wherein the first signal and the second signal are based on the reflected RF signal.

2. The motion detector according to claim 1, wherein the electronic processor is configured to generate the alarm notification when the first signal is greater than a first threshold.

3. The motion detector according to claim 1, wherein the electronic processor is configured to generate the trouble notification when the second signal is greater than a second threshold.

4. The motion detector according to claim 3, wherein the electronic processor is configured to adjust the second threshold to a lesser value when the first signal is indicative of motion at the first range.

5. The motion detector according to claim 1, wherein the first channel is electrically connected in parallel with the second channel, and wherein the first channel and the second channel each receive the reflected RF signal from the antenna and process the reflected RF signal simultaneously.

6. The motion detector according to claim 1, wherein the first channel generates a first Doppler signal based on the reflected RF signal and wherein the first signal is generated based on the first Doppler signal.

7. The motion detector according to claim 1, wherein the second channel generates a second Doppler signal based on the reflected RF signal, and wherein the second signal is generated based on the second Doppler signal.

8. The motion detector according to claim 1, wherein the dual-channel reception circuit is controlled by a time gate circuit such that the first channel and the second channel each receive control signals from the time gate circuit simultaneously.

9. A method of detecting motion using a motion detector with antimasking capability, the method comprising:

receiving a first signal from a first channel of a dual-channel reception circuit, the first signal indicative of motion at a first range and based on a reflected radio frequency (RF) signal;

receiving a second signal from a second channel of the dual-channel reception circuit indicative of motion at a second range based on the reflected RF signal, at least a portion of the second range being shorter than the first range, generating, by an electronic processor, an alarm notification indicative of an alarm condition when the first signal is indicative of motion at the first range, and generating, by the electronic processor, a trouble notification indicative of a masking attempt when the second signal indicates motion at the second range.

10. The method according to claim 9, wherein generating the notification based on the first signal and the second signal includes generating the alarm notification when the first signal is greater than a first threshold.

11. The method according to claim 9, wherein generating the notification based on the first signal and the second signal includes generating the trouble notification when the second signal is greater than a second threshold.

12. The method according to claim 11, the method further comprising adjusting the second threshold to a lesser value when the first signal is indicative of motion at the first range.

13. The method according to claim 9, the method further comprising receiving the reflected RF signal at an antenna and processing the reflected RF signal in parallel and simultaneously at each of the first channel and the second channel.

14. The method according to claim 9, the method further comprising generating a first Doppler signal by the first channel based on the reflected RF signal, and wherein the first signal is based on the first Doppler signal.

15. The method according to claim 9, the method further comprising generating control signals at a time gate circuit to control the dual-channel reception circuit such that the first channel and the second channel each receive control signals from the time gate circuit simultaneously.

16. A motion detector with antimasking capability, the motion detector comprising:

a radio frequency (RF) transmission circuit;

a first RF reception circuit including a first amplifier electrically connected to a first mixer, a second RF reception circuit including a second amplifier electrically connected to a second mixer, the second RF reception circuit electrically connected in parallel with the first RF transmission circuit, and an electronic processor that is electrically connected to the RF transmission circuit, the first RF reception circuit and the second RF reception circuit, the electronic processor configured to generate an RF signal via the RF transmission circuit, send a first control signal to the first RF reception circuit to generate a first Doppler signal indicative of motion at a first distance, send a second control signal to the second RF reception circuit to generate a second Doppler signal, the second Doppler signal being indicative of motion at a second distance, the second distance being shorter than the first distance, generate an alarm notification indicative of an alarm condition when the first Doppler signal is indicative of motion at the first distance, and generate a trouble notification indicative of a masking attempt when the second Doppler signal indicates motion at the second distance, wherein the first Doppler signal and the second Doppler signal are based on RF reflections of the RF signal.

17. The motion detector of claim 16, wherein electronic processor is configured to send the first control signal and the second control signal after transmission of the RF signal is complete.

18. The motion detector of claim 16, wherein the first control signal is different than the second control signal.

19. The motion detector of claim 16, wherein the first control signal controls a first activation time of the first RF reception circuit and the second control signal controls a second activation time of the second RF reception circuit.

20. The motion detector of claim 19, wherein the first activation time of the first RF reception circuit is longer than the second activation time of the second RF reception circuit.

* * * * *